US010731942B1

(12) United States Patent
Schaar

(10) Patent No.: US 10,731,942 B1
(45) Date of Patent: Aug. 4, 2020

(54) MAGNETICALLY ENHANCED ARROW REST

(71) Applicant: John Graham Schaar, Tempe, AZ (US)

(72) Inventor: John Graham Schaar, Tempe, AZ (US)

( * ) Notice: Subject to any disclaimer, the term of this patent is extended or adjusted under 35 U.S.C. 154(b) by 0 days.

(21) Appl. No.: 16/375,781

(22) Filed: Apr. 4, 2019

(51) Int. Cl.
*F41B 5/22* (2006.01)
*F41B 5/14* (2006.01)

(52) U.S. Cl.
CPC ..... *F41B 5/143* (2013.01)

(58) Field of Classification Search
CPC ..... F41B 5/143
USPC ..... 124/44.5
See application file for complete search history.

(56) References Cited

U.S. PATENT DOCUMENTS 2,980,097 A * 4/1961 Rothgery ..... F41B 5/143 124/44.5
3,342,173 A * 9/1967 Ferguson ..... F41B 5/143 124/44.6
3,769,956 A * 11/1973 Simo ..... F41B 5/143 124/44.5
4,133,334 A * 1/1979 Tone ..... F41B 5/1438 124/44.5
4,473,058 A * 9/1984 Terry ..... F41B 5/143 124/24.1
4,548,189 A * 10/1985 Pietraszek ..... F41B 5/143 124/24.1
4,676,220 A * 6/1987 Pietraszek ..... F41B 5/143 124/44.5
4,860,719 A * 8/1989 Scheiterlein ..... F41B 5/143 124/25
4,924,841 A * 5/1990 Smith ..... F41B 5/1438 124/44.5
5,249,565 A * 10/1993 Saunders ..... F41B 5/143 124/24.1
5,503,136 A * 4/1996 Tone ..... F41B 5/143 124/44.5
5,896,849 A * 4/1999 Branthwaite ..... F41B 5/143 124/44.5
5,915,369 A * 6/1999 Sheliga ..... F41B 5/143 124/44.5
6,082,348 A * 7/2000 Savage ..... F41B 5/143 124/44.5
6,561,174 B1 * 5/2003 Afshari ..... F41B 5/143 124/44.5

(Continued)

*Primary Examiner* — Alexander R Niconovich

(57) ABSTRACT

An arrow rest for an archers bow that co-acts with a magnetic catch that may hold the arrow on the rest when the bow is drawn back; and that holds a horizontally pivoting arrow support arm, made of magnetically attractive material, that pivots toward and away from the vertical surface of the bow in the sight window area of the bow, in close to the vertical surface of the bows sight window when the pivoting arrow support arm, is in a fully retracted position and not otherwise in use, so as to avoid possible damage from being caught on limbs and brush while being carried by the archer in the field. The magnet part of the arrow rest further helps move the horizontally pivoting arrow support arm out of the way of the arrows fletching as it passes by the rest so that arrow flight is not unduly disrupted as the arrow is leaving the bow. The rest may be constructed in multiple separated parts or co-joined into a single unibody component.

5 Claims, 5 Drawing Sheets

REAR VIEW

SIDE VIEW

(56) References Cited

U.S. PATENT DOCUMENTS

| | | | | |
|---|---|---|---|---|
| 6,681,753 | B2 * | 1/2004 | Afshari | F41B 5/143 124/44.5 |
| 6,688,297 | B1 * | 2/2004 | Clague | F41B 5/143 124/44.5 |
| 6,920,870 | B2 * | 7/2005 | Minica | F41B 5/143 124/44.5 |
| 7,047,959 | B2 * | 5/2006 | Simo | F41B 5/143 124/44.5 |
| 7,165,543 | B2 * | 1/2007 | Simo | F41B 5/143 124/24.1 |
| 7,963,279 | B2 * | 6/2011 | Harwath | F41B 5/143 124/24.1 |
| 9,568,272 | B2 * | 2/2017 | Grace, Jr. | F41B 5/143 |

* cited by examiner

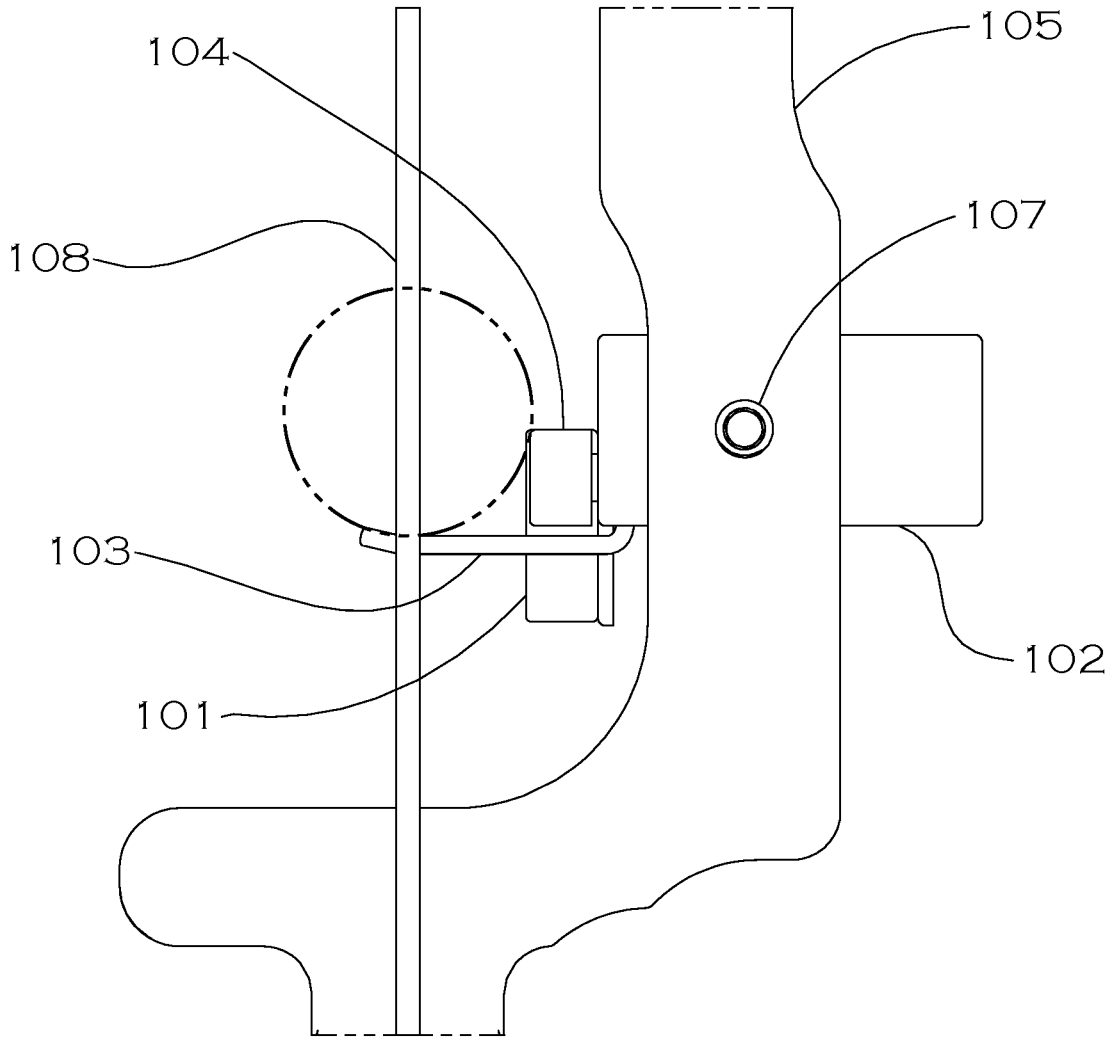
Fig 1(A) - Rear View

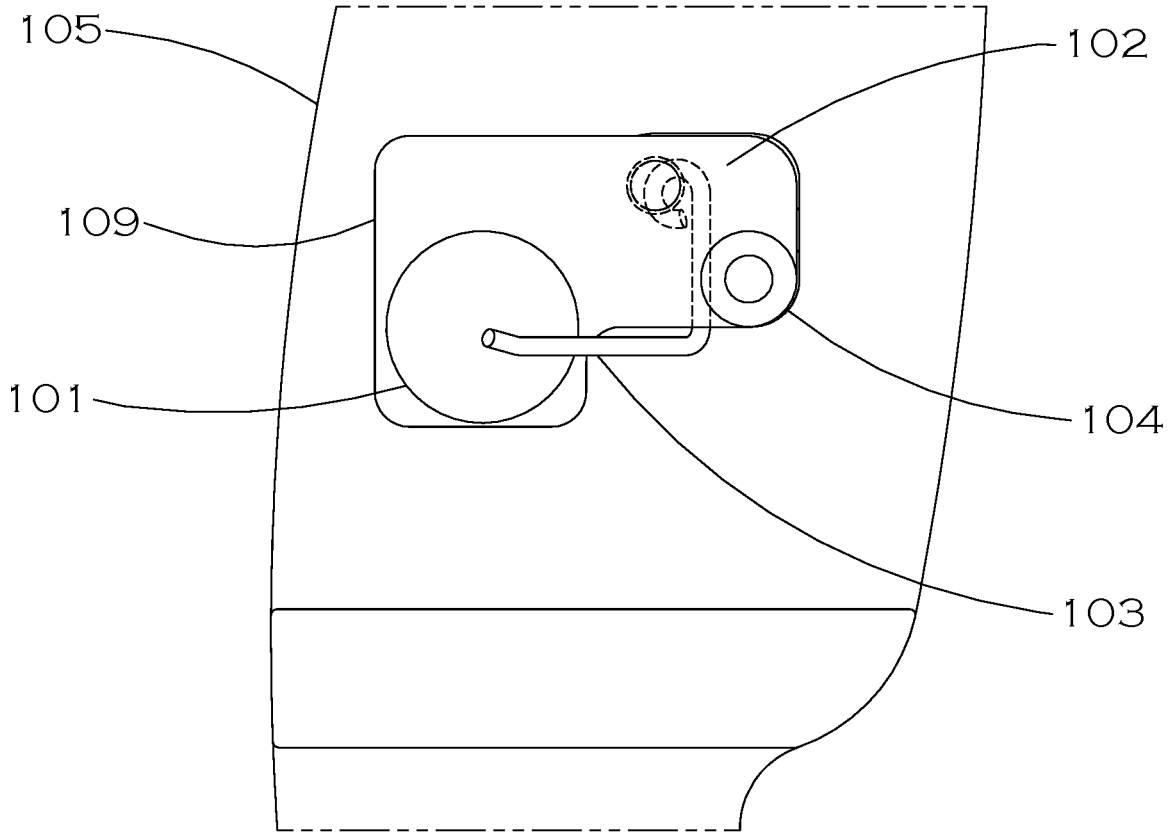
Fig 1(B) - Side View

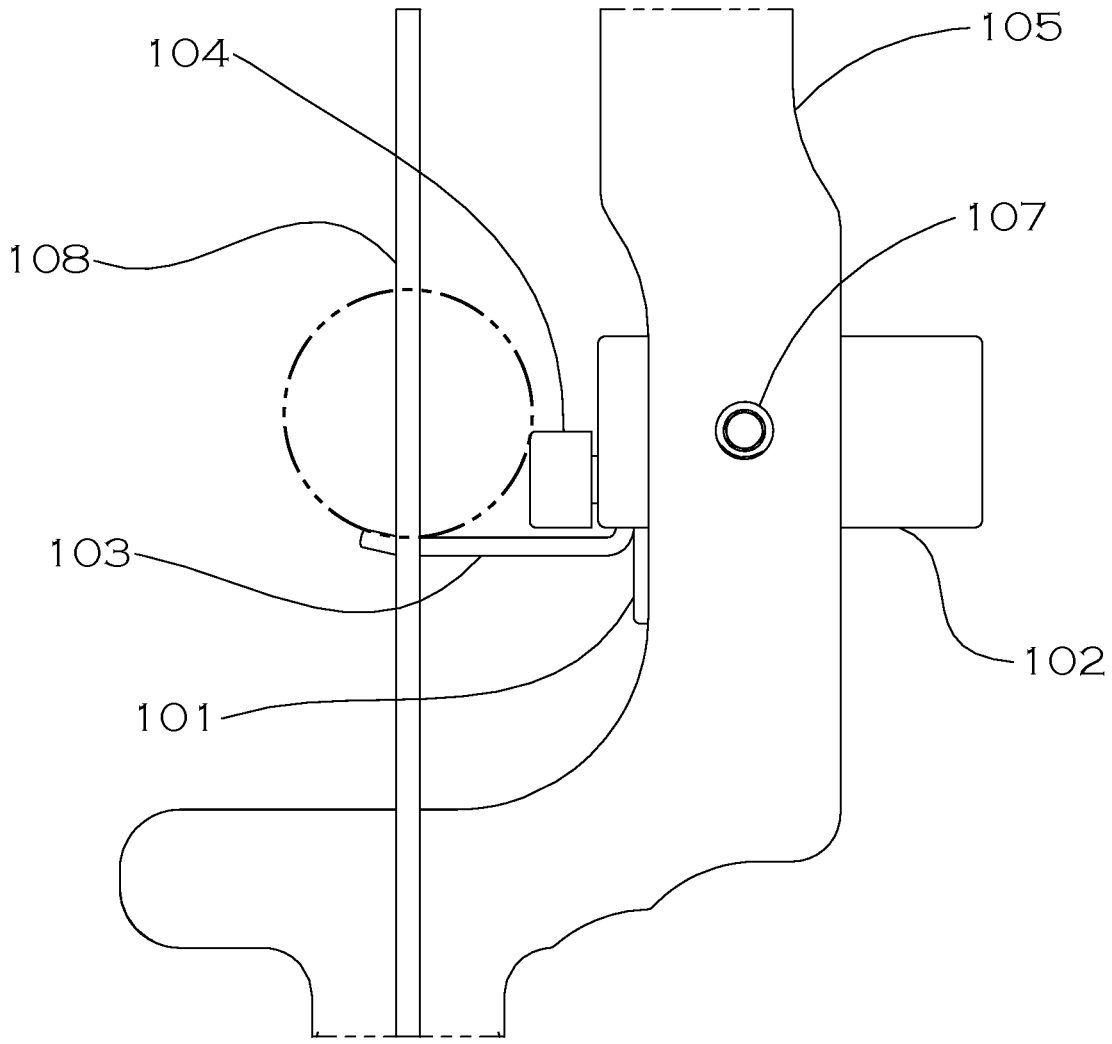
Fig 2(A) - Rear View

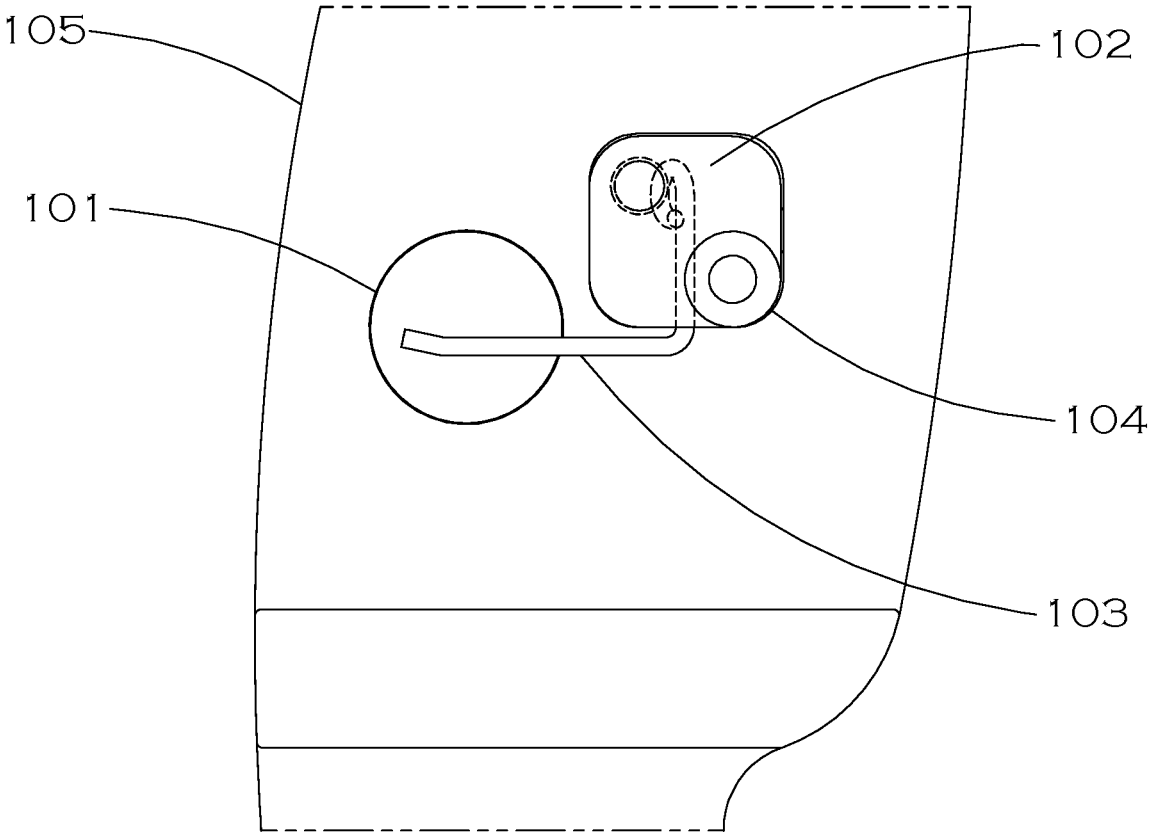
Fig 2(B) - Side View

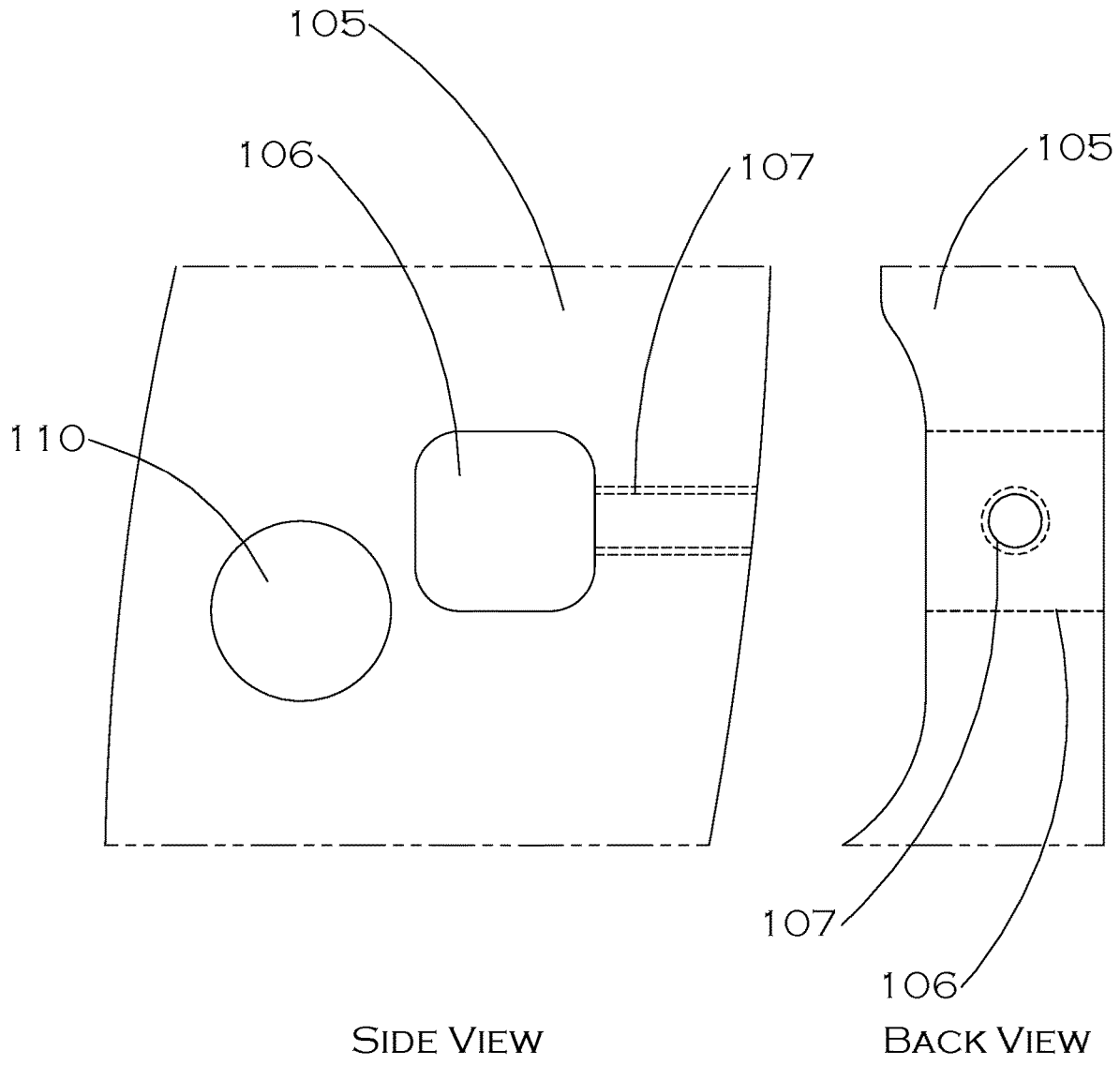
Fig 3 - Riser Prep For Rest Mouting

MAGNETICALLY ENHANCED ARROW REST

PRIOR ART CITATIONS (see citations also attached separately on PTO form BB/08a).

Citations are included here as well as on form SB/08a to elaborate on areas where the cited patents differ materially from this invention, which elaboration would not fit on the form SB/08a.

U.S. Pat. No. 3,769,956 Simo—Nov. 6, 1973—This invention has no magnets involved but employs a spring-loaded retractable arrow rest arm only—a separate cushion button provides lateral (side) support for the arrow shaft. There is no means provided for keeping he rest arm in a retracted state when the bow (rest) is not in use. It is mounted on the inside face of the bow riser.

U.S. Pat. No. 4,473,058—Terry—Sep. 25, 1984—Uses magnet mounted behind the rear face of the bow riser to accomplish returning the arrow rest arm to an extended "loading" position. There is no provision for keeping the rest arm retracted when the bow is not in use.

U.S. Pat. No. 5,503,136—Tone—Apr. 2, 1996—Rest uses (2) magnets, mounted behind the rest arm, with the rest mounted behind the rear face of the bow riser to accomplish first retracting the rest arm, and then returning it to an extended position ready to load another arrow on the arrow rest. There is also a mechanism included for keeping the rest arm retracted when the bow is not in use, based on changing the bias between the two rear mounted magnets of the invention.

U.S. Pat. No. 5,896,849—Graff and Branthwaite—Apr. 27, 1999—Patent does not involve either magnets or springs or a separate rest-arm but does provide for holding the arrow on the rest when the bow is being drawn back and made ready to shoot. This patented rest provides "full containment" disallowing the arrow to fall off of the rest at any time. Uses plastic filaments encased in a round housing with a slot to allow the arrow shaft to be moved proximate to the center of the circle of filaments. The filaments are very thin and pliable and the arrow fletching simply moves them out of the way as the arrow is leaving the bow. Being resilient, the filaments assume their prior shape and position after each shot is completed.

U.S. Pat. No. 5,915,369—Schleiga,—Jun. 29, 1999—This patent essentially describes a "drop down" type of arrow rest with a mechanical re-cocking arm attachment to "re-latch" the rest arm. No forward-backward pivotable arrow support arm is involved. The re-cocking function calls for employing a complex mechanism to re-set the drop-down rest support arm (raising it up) to a position suitable for positioning another arrow when the archer is preparing to shoot the bow. There is no pivotable (forward-backward) arrow support arm as such. Instead as in all "drop-down" arrow rests, there is a pivotable (up-down) arrow support arm or arms. No magnets are employed in this invention.

U.S. Pat. No. 6,688,297—Clague, Lawrence—October 2004

This invention uses magnets to cause an arrow rest arm to rotate down, pivoting vertically, and forward (drop down-fall away) and then allow a return to a fully extended position. Like the Schleiga invention (U.S. Pat. No. 5,915,369), it uses magnets in conjunction with an (up-down) rotating and vertically pivoting arrow support arm to accomplish its function(s). One magnet is employed as a means of maintaining the arrow support arm in a retracted (down) position when the rest is not otherwise in use.

Both the Schleiga invention (U.S. Pat. No. 5,915,369), and the Clague invention (U.S. Pat. No. 6,688,297) are very complex, requiring many fasteners to complete during assembly, and therefore many points of connection that are prone to vibrating loose when the bow is repeatedly shot, possibly increasing shooting noise in the assembled combinations, and being more prone to failure in the field than many earlier, simpler designs such as the original Flipper rest U.S. Pat. No. 3,769,956 by Simo.

U.S. Pat. No. 6,920,870—Minica—Jul. 26, 2005—This invention calls for using arrows shafts pre-fitted with magnets inside their tube opening, near the front of the arrow shaft, together with a magnetized circle that surrounds the arrow shaft, to cause the arrow to be supported solely by magnetism when the bow is at full draw. No adjustable springback enabled arrow support arm as such is employed, and the magnets are all placed either inside the arrows or the magnetic circle arrow rest mounted behind the bows riser or both.

U.S. Pat. No. 7,047,959—Simo—May 23, 20065: This invention is similar to the Minica invention (U.S. Pat. No. 6,920,870) in that it uses a surrounding magnetic field to support the arrow in a level position once the steel point of the arrow nears the magnetic ring encircling the shaft. Magnets are the only means of supporting the shaft column. No arrow support arm, spring loaded or otherwise, is employed.

BRIEF DESCRIPTION OF THE DRAWINGS RELATING TO THE INVENTION

FIGS. 1*a* and 1*b*. depict an arrow rest (102) wherein the magnet (101) used to attract the pivot mounted and spring loaded arrow support arm (103) out of the way of the arrows fletching as the arrow is leaving the bow, and the spring loaded pivotal and retractable arrow support arm (103) and an adjustable pressure button (104) representing the side to side lateral support for the arrow shaft are co-joined in a single component assembly (FIG. 1B). The side to side (windage) adjustment for the entire co-joined rest component is a single set screw (107) that is accessed from the rear of the bows handle section (105) in the rest area. In this configuration the rest arm (103) is shown to pivot in a plane roughly perpendicular to the vertical centerline of the bow. The arrow support arm is spring loaded, and the spring tension is adjustable so that a balance between the strength of the magnetic field and the resistance provided by the spring tension holding the rest arm in a fully extended position can be adjusted to achieve an optimum all around functional setting.

FIGS. 2*a* and 2*b* depict an arrow rest (102) wherein the two functions (arrow retraction and arrow shaft support arm (103) and the side to side adjustable pressure button (104) representing the side to side lateral support for the arrow shaft are two separate components, positioned on the bows riser so as to accomplish the same identical functions as the co-joined version. In this configuration the rest arm (103) is shown to pivot in a plane roughly perpendicular to the vertical centerline of the bow. The arrow support arm (103) is spring-loaded, and the spring tension is adjustable so that a balance between the strength of the magnetic field and the resistance provided by the spring tension can be adjusted to achieve an optimum all around functional setting. Side to side (windage) adjustments for the rest portion of this combination are accomplished using a set-screw (107) positioned in the back side of body of the riser (105) in line with the through-hole (FIG. 3, 106) that accepts the rest body (102).

FIG. 3. Depicts a bow riser (105) prepared so as to be able to accept rests as depicted in either FIG. 1*a* and FIG. 1*b* or FIG. 2*a* and FIG. 2*b*, and with a recessed round hole (110) to accept a magnet as shown in FIG. 2*a* and FIG. 2*b*. A magnet so positioned might also be used in conjunction with another non-flipper type rest to simply hold the arrow on the rest when the bow is fully drawn back. A forward mounted magnet when used with a non-flipper-type rest, will cause arrows with steel points or steel inserts to be held on the rest when the bow is fully drawn. A non-round through-hole (106) is machined completely through the riser to accept the arrow rest body (102) as shown in FIG. 1*a*, FIG. 1*b*, FIG. 2*a*, and FIG. 2*b*. The rest (102) is held in place side to side by a set screw (107) once any needed windage adjustments have been made.

OBJECTIVES OF THE INVENTION

The invention seeks to accomplish five things concurrently:

1. Reduce the amount of disruption to arrow flight due to the arrows fletching contacting the arrow rest support arm as the arrow leaves the bow.
2. Provide a means for holding the arrow on the rest when the bow is at full draw, thereby eliminating the possibility of the arrow falling off of the rest arm when the bow is fully drawn back.
3. Provide a means of securing the arrow support arm of arrow rests having retractable arrow support arms in a retracted position that is less susceptible to becoming engaged with and possibly bent out of usable shape by brush, tree limbs, etc. when the bow is being carried by the archer in the field.
4. Provide an arrow rest that creates minimal disruption to accuracy due to system torque.
5. Accomplish all of these functions with a small, simple to make, simple to install, very light in weight, fully functional arrow rest for an archer's bow.

BACKGROUND OF THE INVENTION AND PRIOR ART

The need for arrows to clear the bow without undue contact that could disrupt arrow flight is well documented. Most arrow rests now in use provide a way of doing this. Initially the accomplishment of reduced arrow contact with the bow itself was accomplished by adding a "cable guard" attachment to the bow to force the power cables out of the way of arrows passing by. After the arrows fletching cleared the cables, they next had to go by the handle of the bow without making undue contact too. That is where the arrow rests comes into play.

Initially, as far as arrow rests were concerned inventors chose to employ arrow rests with plastic or stiff but resilient piano wire support arms that allowed the arrow fletching to clear the bows handle section. Most employed some combination of springs, pivot mounted spring loaded thin (usually piano wire) wire arrow support arms that retracted to allow free passage of the arrow and then return the support arm to a position ready to accept another arrow being loaded for shooting. These rest types were typically referred to as "flipper" rests. Sometimes the methods for accomplishing these movements used springs, sometimes magnets, sometimes weighted counterbalances. Most such rests required (and still do) a separate attachment to the bow in the area near the arrow shelf of the bow handle to house the rest assembly. Most of these now provide a means of adjusting the rest position up/down and side-to-side.

Keeping the arrow from falling off of the rest when the bow is drawn is another well documented feature of modern-day arrow rests. Arrow rests providing a means of keeping the arrow on the rest are generally called "full-containment" rests. Most such modern-day rests are patterned after the now widely known "whisker biscuit" rest (U.S. Pat. No. 5,896,849) that employ hundreds of thin plastic filaments mounted in a round housing component that surrounds the shaft about 90% of its circumference and leaves just a narrow slot to allow the arrow to be inserted into the desired center of the rest position. These rests require that the arrow fletching push the filaments out of the way as they leave the bow. Fletching and shaft contact is very light, but still present. These rests too generally require a separate attachment to the bow in the area near the arrow shelf of the bow handle to house the rest assembly. Most of these now provide a means of adjusting the rest position up/down and side-to-side.

The latest versions of the "full containment" rests eliminate the filaments and position the arrow shaft on 2-3 smooth contact points which are positioned so as to not make contact with the fletching on the arrow as it leaves the bow.

Recently some arrow rests have employed magnets with biased magnetic field loadings to support the arrow free of any contact with the bow whatsoever when the bow is fully drawn back.

A third category of arrow rests seek to support the arrow during the time the bow is being drawn back, but to then move out of the way completely once the string is released. These types of rests are sometimes called "drop-down" or "fall-away" rests.

Some of the "drop-down" and "fall-away" rests are constructed to function as "full-containment" rests at the same time. Most of these require a separate "timing" cable that connects the arrow rest support component, mounted on the bows riser, to a power cable on the bow to effect timing relating to when the arrow rests "drop-down" feature stops providing vertical support to the arrow shaft. Most of these now provide a means of adjusting the rest position up/down and side-to-side.

Most of the "full containment", "drop-down", and "fall-away" arrow rests are constructed of heavy-duty plastics like ABS or carbon filaments, or aluminum, or some combination of these and as such are usually able to withstand some contact with brush and limbs just due to mass and strength of the materials they are made of. Arrow rests using thin and lightweight wire retractable support arms however are typically less robust, having arrow support arms that protrude away from the sight window when not in use (in an extended position) and which are more susceptible to damage from contact with brush, tree limbs etc. when being carried in the field.

As arrow rests evolved to provide more than just a single function (supporting the arrow in a fixed position on the bow) and sought to provide "zero-contact" with the arrows fletching, and "full containment" aimed at disallowing the arrow from falling off of the rest itself, increased durability, and nearly infinite up/down and side-to-side positioning; the arrow rests in general got larger in size, more complex, heavier, more unwieldy, noisier, and much more expensive.

The added weight, especially of the new generation of highly complex arrow rests, being mostly mounted on the back side of the sight window of the bows riser (handle)

contributes toward system torque in the assembled condition and will absolutely affect arrow flight just by being mounted on the bow. "System" torque results from the bow, including any attachments to the bow itself, being heavier on one side than the other side or the top half being heavier than the bottom half. The bow moves in the archers hand instantly when the string is released, and "system" torque can adversely affect accuracy, penetration, and trajectory just as limb/pulley torsion does.

Very simple arrow rests for recurve bows 40 years ago, having retractable arrow support arms, typically weighed about 20-30 grains (437 grains is one ounce) and at that weight contributed little to system torque in the bow with such a rest in place. Some current day arrow rests may weigh ¼-⅜ of a pound or more, and weights in that range can seriously disrupt arrow flight due to the added system torque they induce.

Recognition of this unwanted condition led to other inventions (stabilizers that place weights off to the opposite side of the bow, counter-balances, etc.) that are designed to reduce the negative effects on arrow flight of the out of balance condition caused by mounting the complex and heavy arrow rests on the bows handle section.

Kludges on top of kludges so to speak.

SUMMARY OF THE INVENTION

The invention seeks to answer the objectives laid out in the abstract using a combination of an arrow rest that employs a springback enabled, pivot mounted, strong and lightweight but resilient, arrow support arm that, absent the inventions unique structure, would be unduly subject to bending/twisting damage in the field. The arrow support arm incorporates a material (typically carbon steel) that can be attracted by a magnet. A magnetic "catch" is mounted forward of the pivot point of the support arm that the arrow rests on. The springback enablement might be provided by a simple spring or an elastic polymer material, or perhaps another way entirely. A simple coil spring of a given strength would probably be the choice of most rest builders using the teachings of this invention.

Similar to the cocking of the hammer of a single action revolver, the support arm of the inventive arrow rest must be cocked by the archer after each shot, in order to load another arrow on the rest. The inventive arrow rest is the only arrow rest of any kind that does NOT provide a means of returning the arrow shaft support arm to a position suitable for loading another arrow on the rest and is unique in this regard.

The elimination of the "re-cocking" mechanism as part of the rest, instead utilizing a magnet to catch and hold the support arm close into to the main body of the sight window after each shot:

- Greatly simplifies the overall arrangement while still allowing the rest to significantly reduce fletching contact with arrows leaving the bow;
- Holds the arrow in place on the rest when the bow is fully drawn back;
- Holds the support arm in close to the bow riser when not in use, thereby discouraging engagement with brush and limbs, and possibly becoming accidentally deformed, when being carried by the archer in the field; and further:
- provides the basis for achieving all of these concurrently using a footprint that is a small fraction of what other rests providing similar functionality require, and which weighs significantly less than other rests capable of providing similar functionality.

DESCRIPTION OF THE PREFERRED EMBODIMENT

Following is what the inventor considers an optimal embodiment of the invention. The preferred embodiment is but one of many possible ways to configure a rest and one or more magnets mounted forward of the arrow rest to accomplish the aims of the invention. Those knowledgeable in the art will be able to discern other embodiments that might also work well. The possibility of other embodiments, all falling within the scope of this invention, is believed to be a significant benefit of this invention.

FIG. 2*a* shows a bow riser (105) as seen from behind the bow, that has been prepared ahead of time by having a non-round through-hole FIG. 3, (106) and a recessed hole FIG. 3 (110) deep enough to accept a round magnet as shown in FIG. 2*b* (101). The rest body (102) is adjusted left and right by sliding the rest body by hand until the desired windage setting is found, and once the correct windage setting is determined, the rest body is fixed in place with a set screw (107). Typically, the windage adjustment will center around getting the body of the rest (102) positioned left to right so that the lateral arrow positioning point (104) has both the bowstring (108) and the arrow (dotted line circle in FIG. 1*a* and FIG. 2*a* centered with the lengthwise centerline of the limbs and the bows grip. However, the centering of the rest to align the lateral positioning of the arrow to coincide with a bowstring positioned to line up with the vertical centerline of the bow's limbs and/or grip, while believed to be the best way to go, is not a requirement of the invention. When the bow is shot, the arrow fletching initially contacts the pivotable, springback enabled, rest arm (103) and the rest arm begins pivoting forward. As the rest arm comes into the magnets attractive range the magnet further pulls the rest arm to it and holds it in a retracted position FIG. 2*b* (103) after the arrow passes by. In the retracted position the arrow rest arm is much less vulnerable to getting snagged on brush. The archer manually resets the arm in the extended open position as in FIG. 2*a*, (103) as part of preparing to shoot the bow again.

Summary of Arguments Supporting Patent Issuance:

1. The invention teaches against prior art.

All other magnetic flipper-type rests assume the magnets should be positioned at the back end of the rest and near the backend of the riser (closer to the archer) in order to provide for returning the support arm to a fully extended position ready for loading another arrow on the rest after the support arm has been retracted (moved out of the way of the arrow passing by). The inventive arrow rest positions the magnets in front of the pivot point of the arrow support arm between the arrows resting place on its pivot arm, and the front of the bows riser so as to also function as a "catch", and requires the archer to manually move the arm back into an extended position ready for receiving another arrow on the rest.

All prior art arrow rests assume that the rest must incorporate a mechanical, springback enabled, or magnetic means of returning the arrow rest support arm to a position ready to load another arrow on the rest after each use. The instant invention presupposes the archer will manually provide that function, in return for additional benefits in another area or areas.

2. The invention employs a novel and unique combination of well-known elements in meeting a previously unmet need in arrow rests with pivoting arrow support arms.

The unique configuration of a springback enabled pivoting arrow support arm and magnetic "catch" provides a benefit unavailable on all other rests with pivot mounted arrow support arms in that the magnet holds the arrow support arm in a retracted position immediately next to the bows riser when the bow is not in use, thereby providing a measure of protection against accidental damage from contact with brush, tree limbs, etc. in the field that no other rest with a pivoting support arm that is automatically moved into a fully extended position after each shot provides.

3. The invention combines multiple useful functions into a single part.

The inventive arrow rest further accomplishes all its objectives using fewer parts, since the single magnet is made to serve four total functions, (1. reducing fletching contact with the rest as the arrow leaves the bow, 2. holding the arrow on the rest when the bow is fully drawn back, 3. securing the arrow support arm in a manner that reduces possible damage from contact with brush, limbs, etc. when being carried by the archer in the field, and 4. greatly reducing the need for counter-balancing weights to be added to the bow to offset system torque due to the arrow rests magnetic element being very light in weight and positioned inside the bows riser itself).

In this invention, all of these functions can be accomplished by a single magnet component due to its unique positioning between the pivot point of the springback enabled arrow support arm and front of the bow. In all other arrow rests with a pivoting support arm, and having magnets positioned at or near the rear of the bows handle riser component, additional components would have to be added to accomplish all of the functions that a single magnet accomplishes in this invention.

Having described my invention with text and drawings, and having shared what I believe to be the preferred embodiment of my invention, so that others may profit from its teachings, and also having specified adequate reasons for patent allowance, I now claim of the following:

1. An arrow rest assembly for an comprising:

A base section of a two-component arrow rest embedded in or attached to a vertical surface of an archer's bow, said vertical surface of said bow for embedding or attachment of said base section of said arrow rest being on a vertical side of said bow, that most closely aligns with a vertical plane containing a bowstring of said bow said base section of said two component arrow rest housing a spring operated, horizontally pivoting, arrow rest support arm and further incorporating an integral means of providing side to side support for an arrow when an arrow is resting on said spring operated horizontally pivoting arrow support arm as the bow is being drawn and released, with both said horizontally pivoting arrow support arm and said means of providing side to side support for an arrow resting on the horizontally pivoting arrow support arm, emanating from or closely proximate to the same surface of said arrow rest base section, and said emanating surface of said base section of said rest being generally parallel to the vertical surface of the bow that said base section of the rest is attached to or embedded in, said spring operated arrow support arm pivoting horizontally toward, and away from, the vertical surface of said bow where said base section of said arrow rest is attached or embedded, when said horizontally pivoting arrow support arm of said arrow rest is contacted by an arrows fletching as an arrow leaves said bow upon release, said horizontally pivoting arrow support arm moving toward said vertical surface of said bow and back away from said vertical surface of said bow in a plane roughly perpendicular to a plane containing a bowstring of said bow when said bow is assembled and not drawn back, said horizontally pivoting arrow support arm providing vertical support for an arrow when said spring operated, horizontally pivoting arrow support arm is in the extended open position and an arrow is resting on said arrow support arm, as said bow is being drawn and released, said spring operated horizontally pivoting arrow support arm made of magnetically attractive material, said means of providing side to side support for an arrow positioned in or on said horizontally pivoting arrow rest support arm to be positioned on said arrow rest base section with respect to said arrow rest arm so as to provide lateral support for an arrow when said spring operated, horizontally pivoting arrow rest support arm is in the extended open position and an arrow is resting on the arrow support arm, and further positioned so as to not interfere with movement of said arrow rest arm, said means of providing side to side support for an arrow mounted on said arrow rest support arm to incorporate a portion made of a resilient and limited friction material of, Delrin or Teflon or Nylon where said portion of said side to side support means engages a rounded side of an arrow mounted on said spring operated, horizontally pivoting arrow rest support arm as said bow is drawn and released, A separate magnet section of a two-component arrow rest embedded in or attached to the vertical surface of said bow, said separate magnet section positioned in a vertical section of said bow in or on the same side of said bow as said base section of said arrow rest is attached to or embedded in, and in or on the same side of said vertical section of said bow as said spring operated horizontally pivoting arrow support arm of said arrow rest base section is attached to or embedded in, said magnet further positioned so as to have said magnet aligned vertically in the same horizontal plane of operation of said spring loaded horizontally pivoting arrow support arm, said magnet further positioned between said horizontally pivoting arrow support arm and an intended target, such that an arrow leaving the bow would pass by at least a part of a surface of said magnet, and a free end of said spring operated horizontally pivoting arrow support arm would move in a pivoting manner forward and toward said magnet when an arrows fletching contacted said spring operated horizontally pivoting arrow support arm upon release, said magnet further positioned so that said spring operated horizontally pivoting arrow support arm would, when fully retracted, be in contact with or close proximity to said magnet and thereafter remain held by magnetic force in a fully retracted position until manually reset to a fully extended open position, said magnet to be of sufficient magnetic strength to be able to attract said spring operated horizontally pivoting arrow support arm, said support arm made of magnetically attractive material, to a fully retracted position after an arrow first moves said spring operated horizontally pivoting arrow support arm part way toward said magnet when an arrows fletching contacts and moves said spring loaded horizontally pivoting arrow support arm forward and toward said magnet as an arrow leaves the bow, and said magnet to have an attractive magnetic strength insufficient to move said spring operated horizontally pivoting arrow support arm forward and toward it when said arrow support arm is in the fully extended open position.

2. An arrow rest assembly as in claim 1, wherein said base section of said arrow rest that houses said spring operated horizontally pivoting arrow support arm and said side to side arrow lateral support surface is comprised of a non-round elongated shaped, straight, length formed of metal or plastic, said elongated section comprised of two ends and a solid section joining the ends, and being approximately one inch in length, and having a uniform cross section over its entire length and at each of its ends that are substantially square or rectangular in end shape, said elongated rest body to be received or embedded in a closely fitting, proportionally shaped recess in said vertical section of said bows riser, said recess providing a close tolerance fit for the end shape and perimeter of said elongated arrow rest base section along its entire length, said recess consisting of a non-round hole shaped proportionally to said elongated arrow rest body, extending side to side completely through said bows vertical section above a grip section of said vertical section, such that said non-round, elongated arrow rest base section, when fitted through said matching hole in said bows vertical section, may be moved sideways toward either of its ends to fine tune arrow lateral alignment as needed to match an arrows stiffness, said elongated arrow rest base section fixed in place with a set screw positioned directly in line with a center of said elongated rest body receiving recess, and emanating from a rearmost surface of the bows vertical section that said rest body is embedded in, once a desired left to right positioning of said elongated base section is completed.

3. An arrow rest assembly of claim 1, wherein said arrow rest base section is adjustable to increase or decrease spring tension in said spring operated horizontally pivoting arrow support arm.

4. An arrow rest assembly of claim 1, wherein said arrow rest base section is adjustable to increase or decrease side to side resistance in the lateral arrow support surface.

5. An arrow rest assembly of claim 2 wherein the arrow rest body which houses the spring operated horizontally pivoting arrow support arm and which also houses the means of providing side to side support for an arrow resting on said spring operated horizontally pivoting arrow support arm is combined into a single fixed unit with the co-acting magnet, with said arrow rest base first being modified to incorporate a mounting platform for said magnet, said mounting platform to be fixedly attached to and made part of the base section of the arrow rest, and said fixedly attached platform positioned immediately alongside said arrow rest base's end from where the spring operated horizontally pivoting arrow rest arm emanates such that a magnet attached to or embedded in the platform, and said elongated rest base may be made to move in unison, with said arrow rest base and fixedly attached platform with attached or embedded magnet combined into a single unit being fixed in place in said bow with a set screw positioned directly in line with the center of said elongated rest body receiving recess in said bows vertical section, and emanating from a backmost surface of the bows vertical section that said rest body is embedded in, once any desired left to right positioning of said elongated base section is completed; with all spatial relationships between said arrow rest base section and co-acting magnet being substantially unchanged, and with all movements of said spring operated, horizontally pivoting, arrow rest arm being substantially unchanged.

* * * * *